United States Patent [19]

Bertagnoli

[11] 3,959,994

[45] June 1, 1976

[54] CIRCULAR KNITTING MACHINE CAM ARRANGEMENT

[75] Inventor: Leopoldo Bertagnoli, Torino, Italy

[73] Assignee: Nuova San Giorgio S.p.A., Milan, Italy

[22] Filed: Nov. 18, 1974

[21] Appl. No.: 524,477

[30] Foreign Application Priority Data

Jan. 7, 1974 Italy ..... 19144/74

[52] U.S. Cl. ..... 66/54; 66/57; 66/27

[51] Int. Cl.[2] ..... D04B 15/32

[58] Field of Search ..... 66/27, 57, 54, 23, 71, 66/77

[56] References Cited

UNITED STATES PATENTS

| | | | |
|---|---|---|---|
| 2,495,872 | 1/1950 | Stibbe et al. | 66/27 |
| 2,756,574 | 7/1956 | Shortland | 66/27 |
| 2,823,529 | 2/1958 | St. Pierre et al. | 66/57 X |
| 3,123,991 | 3/1964 | Schmidt | 66/54 |
| 3,148,518 | 9/1964 | Peel et al. | 66/57 X |
| 3,387,467 | 6/1968 | Beckenstein | 66/57 |
| 3,525,239 | 8/1970 | Agulnek | 66/54 |
| 3,572,056 | 3/1971 | Radin | 66/57 |

FOREIGN PATENTS OR APPLICATIONS

| | | | |
|---|---|---|---|
| 498,647 | 9/1954 | Italy | 66/77 |
| 17,648 | 11/1902 | Sweden | 66/77 |

*Primary Examiner*—Mervin Stein
*Assistant Examiner*—Andrew M. Falik

[57] ABSTRACT

A lock for circular knitting machines. According to the invention, a lock or cam comprises a fixed lock element supporting or carrying cams defining the guide tracks for the knitting needle heels, causing the outgoing and re-entering movements of said needles; such cams are secured to a slider movable between extreme positions within a guide of said fixed lock element. The slider has a threaded portion engaging a first screw thread of a manually operable adjusting element for the slider stroke, which adjusting element is provided with a second screw thread in opposite direction to the former; this second screw thread screwing in a threaded seat of the fixed lock element, so that at a rotation of said adjusting element there would correspond an overall displacement of the cam carrying slider equal to the sum of the displacement of said slider relative to the adjusting element and of that of the latter relative to said fixed element.

10 Claims, 5 Drawing Figures

CIRCULAR KNITTING MACHINE CAM ARRANGEMENT

BACKGROUND OF THE INVENTION

This invention relates to improvements in locks for circular knitting machines. More particularly, the invention is concerned with both the locks for controlling the cylinder needles and the locks for controlling the dial needles in said circular knitting machine.

As known, locks or cams for circular knitting machines substantially comprise cams defining the guide tracks for the heels of the knitting needles, determining the outgoing and reentering movements of the needles. Such guide cams are generally carried on a fixed lock sector outside of the plate, or respectively of the needle cylinder of the circular knitting machine.

It is essential to adjust the needle stroke in order to control the length of the return stroke of each needle and accordingly the length of the loop being formed. This is accomplished by suitably varying the position of the guide cams according to the desired adjustment.

With the prior art locks, the correct positioning or adjustment of the position for the guide cams is rather difficult. It would suffice to remind that certain circular knitting machines require a high amount of locks (48 or more), so that it is difficult to have an accurate indication and provide an identical correct positioning for all of the cams.

SUMMARY OF THE INVENTION

Therefore, it is the object of the present invention to provide a lock for circular knitting machines, wherein the adjustment of the position for the guide cams of the needle heels can be manually effected outside of the machine in an extremely simple and rapid manner.

It is a further object of the present invention to provide such a lock for circular knitting machines as above mentioned, wherein the correct relative position of the cams can be always determined by means of an external index.

It is a further object of the present invention to provide a lock for circular knitting machines, as above specified, wherein a full adjustment stroke for the cams can be accomplished by a single complete revolution of a control member, whereby the reading of the cam position on a reference scale of the control member is made extremely simple.

Generally, according to the invention, a lock for circular knitting machines, comprising a fixed lock element for supporting the cams defining the guide tracks for the heels of the knitting needles, determining the outgoing and re-entering movements of the needles, is characterized in that said cams are secured to a slider movable within a guide of said fixed lock element, said slider having a threaded portion engaging a first thread of a manually operable adjusting element for the slider stroke, said adjusting element having a second thread of opposite pattern to the former, this second thread fitting in a threaded seat of said fixed lock element, so that at a rotation of said adjusting element there will correspond an overall displacement of the cam supporting slider equal to the sum of the displacements of the slider relative to the adjusting element and of the latter relative to said fixed lock element. Opposing springs enable to take up the clearances or plays between the threads to ensure always a correct positioning of the needle guide cams.

Preferably, the overall adjusting stroke of the slider between its two extreme positions is equal to or less than the sum of the pitches of said two opposite threads, so that by a single complete or partial rotation of said threaded adjusting element, the full adjusting stroke for the cams can be effected.

According to a particular preferred embodiment of the invention, the slider is connected by means of the same set of screws of the cams to a threaded pin which engages a first inner thread of a screw forming said adjusting element, said screw having a second outer thread opposite to the former and carrying on its outer side a graduated vernier for providing the correct position of the cams with respect to a fixed reference.

These and other features of a lock according to the invention will now be more particularly described with reference to the exemplary embodiment shown in the accompanying drawings, in which:

DETAILED DESCRIPTION OF THE PREFERRED EMBODIMENT

Figures 1, 2, 3, 4, 5:
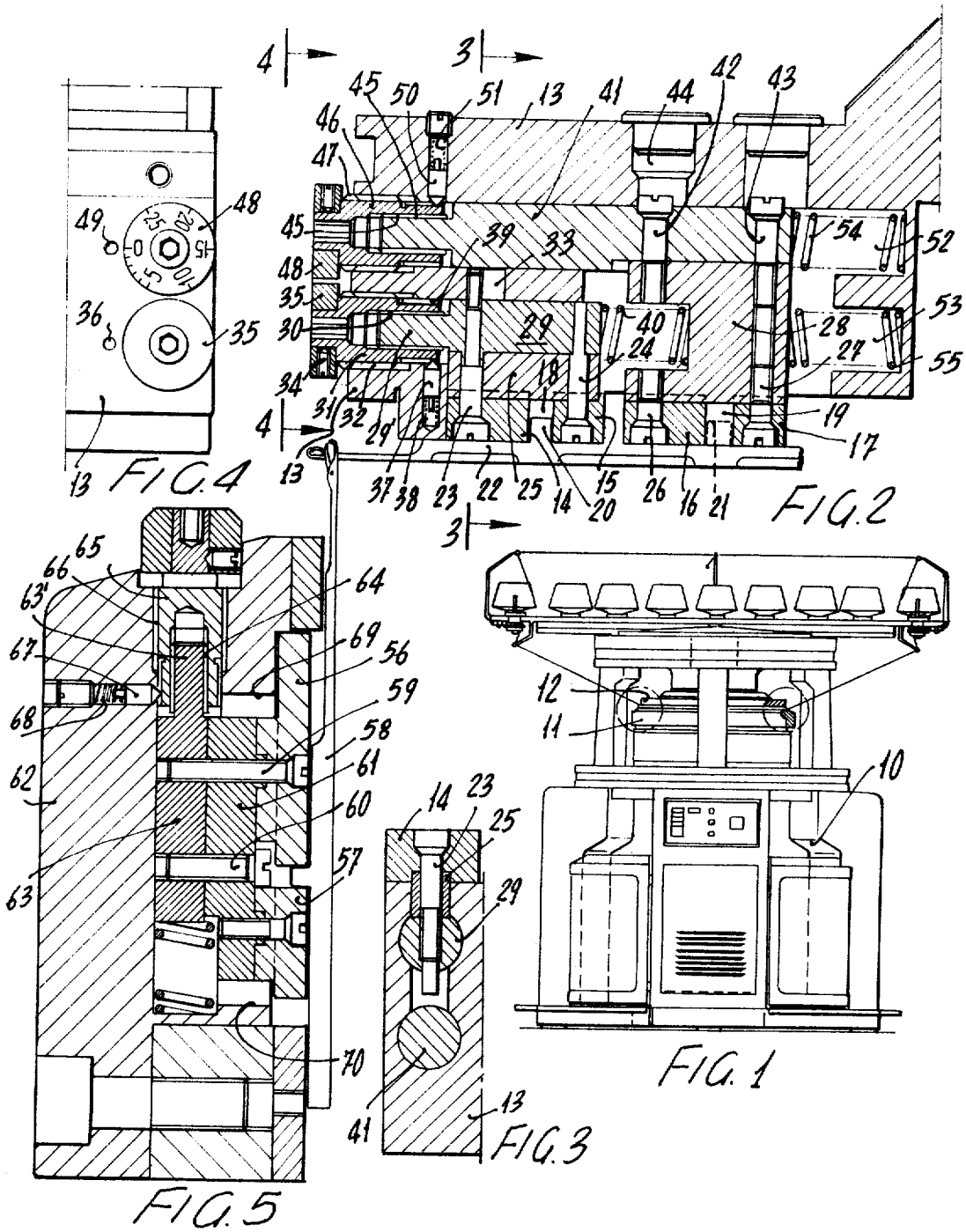
FIG. 1 shows a circular knitting machine incorporating the locks according to the invention.
FIG. 2 is a sectional view on a radial plane showing a lock for the needle plate of the circular knitting machine shown in FIG. 1.
FIG. 3 is a cross-section taken along line 3—3 of FIG. 2.
FIG. 4 is an end view according to line 4—4 of FIG. 2.
FIG. 5 is a view on a radial plane for a lock of the needle cylinder in the machine shown in FIG. 1.

FIG. 1 shows a general design of a circular knitting machine which will not be herein described to further detail, except for those details relating to the invention.

Generally, a circular knitting machine as shown in FIG. 1 has a structure 10 supporting the rotating needle cylinder or roller and plate, cooperating during the rotation thereof with the associated locks to cause the outgoing and re-entering movement for the knitting needles according to the controls as imparted by the per se known pattern reproducing devices.

The cylinder locks form a cam box 11 externally surrounding the needle cylinder, while the plate locks or cams are carried by a lock ring 12 positioned at the top or on the outside of said needle plate.

FIGS. 2–5 of the accompanying drawings are enlarged details of a plate lock and a cylinder lock, respectively, substantially located at a zone defined by a circle in FIG. 1.

Referring now to FIGS. 2–4, a preferred embodiment of a needle plate lock or dial cam plate will be described.

Referring to FIG. 2, it will be seen that reference numeral 13 denotes a fixed lock element carrying, for example, cams 14, 15, 16 and 17 defining the tracks 18 and 19, respectively, for the sliding or guide of the heels 20 and 21, respectively, of the knitting needles 22 carried in a per se known manner by radial grooves in a needle plate, not shown in FIG. 2.

For displacing and hence adjusting the needle guide cams, the cams 14 and 15 are inerchangeably secured, for example by screws 23, 24, to a slidable element 25 moving within a radial guide formed in the above mentioned ring sector 13. Similarly, cams 16 and 17 are secured, for example by screws 26, 27, to a second slidable element 28 moving within its radial guide formed in the ring sector 13.

A pin 29 is secured to said slider 25, for example still by means of screws 23 and 24, with the threaded end 29' of this pin engaging an inner thread 30 of a manual adjusting element, such as a screw 31, having a second outer thread 32 engaging a corresponding threaded hole on the edge of said ring sector 13. According to the principles of the present invention, the screw threads 30 and 32 of the adjusting element have threads with opposite directions, so that at each rotation and associated displacement in one direction of said adjusting screw 31, in the same direction of this screw 31 a displacement corresponds for the assembly comprising said pin 29, slider 25 and cams 14 and 15. That is to say, said screw threads are provided so that individual displacement of one of the moving parts of the lock will always produce an additive displacement of the other moving parts.

Stationary abutment surfaces, such as formed at the ends of a slot or hole 33 in the fixed ring element 13, cooperate for example with a projecting end of a set screw 23 for the threaded pin 29 to define the two extreme locations of the cam holder slider 25.

According to the invention, the screw threads 30 and 32 of the adjusting element 31, as well as those cooperating therewith on the threaded pin 29 and in the hole of the ring sector 13, can be preset so that the sum of the pitches thereof is substantially equal to the maximum adjusting stroke of the cam holder slider 25. Thus, by a single and complete revolution of the adjusting element 31, the full adjusting stroke of the cams can be provided.

The proposed approach is extremely advantageous since a ferrule or ring nut 35 can be applied to the protruding end of the adjusting screw 31, on its outer side this ferrule or ring nut 35 having a linear scale (FIG. 4) which, relative to fixed reference point 36, can give the correct position of said cams.

In order to retain the cams at the adjusted position thereof, a suitable automatic blocking or retaining device is provided, for example comprising a sliding dowel 37 under the action of a thrust spring 38, this dowel acting through its pointed end against the externally knurled portion 39 of said adjusting element or screw 31.

A spring 40 for taking up the plays between the threads is interposed between the slider 25 or pin 29 fast therewith and an opposite surface of a seat which in this particular case is formed in said second slider 28.

The pitches of the two opposite screw threads 30 and 32 may be different from each other, for example the pitch for the external screw thread 32 of the adjusting screw can be greater than that of the internal screw thread 30, provided that the sum thereof is equal to or generally exceeds the cam adjusting stroke.

Fully similarly as the above cited case, the slider 28 carrying the cams 16 and 17 has a pin 41 secured thereto by means of set screws 42, 43 screwing through threaded holes in said pin 41 and slider 28. Through its projecting head, said screw 42 cooperates with opposite surfaces of a hole 44 formed in the lock ring sector 13 to determine the extreme positions for the adjusting stroke of cams 16 and 17.

Pin 41 has a threaded end engaging a corresponding screw thread 45 of an adjusting element or screw 46 having a second external screw thread 47 with threads opposite to the former screw thread 45 to allow for a sum of the relative displacements in both directions of rotation of the screw. Similarly, screw 46 has a ferrule or ring nut 48 secured thereto, this ferrule or ring nut 48 carrying a graduated scale (FIG. 4), on which the position of cams 16 and 17 with respect to a fixed reference point 49 can be read. Also, in this case, a threaded dowel 50 under the action of a thrust spring 51 is effective on an externally knurled portion of the adjusting screw 46 to retain the latter and the slider and cam assembly blocked at the desired adjusted position. It is apparent that in place of the automatic blocking system comprising the dowels 37 and 50, any other automatic blocking system could be used.

Finally, from FIG. 2 of the accompanying drawings it will be seen that between the second slider 28 and the housings or holes 52, 53 formed in the lock ring sector 13 provision is made for springs 54, 55 for taking up the screw threads plays.

As hereinabove set forth, the sum for the pitches of the opposite screw threads 45 and 47 can be equal to or greater than the full adjusting stroke of the cams, so that the latter can be provided by a rotation of the adjusting screw equal to or less than a complete revolution.

From the foregoing it is apparent that, because of the linear corrispondency between the displacements of the adjusting screws 31 and 46 and sliders 25 and 28, respectively, by a simple total or partial rotation of said adjusting screws, depending on the ratio of the sum of the screw thread pitches and the cam adjusting stroke, the cams can be preset at their desired position, always providing an accurate indication on the graduated scale of said ferrules or ring nuts 35 and 48.

In FIG. 5, a lock for the cam box substantially constructed according to the principle of the invention is shown.

Also in this case, the cams 56 and 57 for the knitting needles 58 are secured by means of screws 59 and 60 to a slider 61 slidably carried in vertical guides formed in a stationary portion 62 of the cam box. Still through said screws 59 and 60, a pin 63 is secured to said slider 61, the threaded end 63' of this pin 63 engaging a first internal screw thread 64 of an adjusting element or screw 65, the latter having in turn a second external screw thread 66 with opposite direction to the former and engaging a corresponding threaded hole in the stationary portion 62 of the lock band or cam box. Also in this case, the sum for the pitches of screw threads 64 and 66 can be equal to or greater than the maximum displacement of said slider 61 to allow for adjusting the cams by a single total or partial rotation of the adjusting screw 65. A graduated scale can allow for reading the cam position, entirely similarly as specified in connection with FIGS. 2 and 4 of the accompanying drawings. Likewise, a dowel 67, slidable within a hole in said stationary portion 62, is under the action of a spring 68 urging it to engage against the knurled outer surface of screw 65 to retain the whole at a predetermined adjusted position.

In this case, unlike the case as specified in FIG. 2, the extreme positions of the slider are defined by two surfaces 69 and 70 of the stationary portion 62 of the lock band, against which said slider 61 abuts.

All of the matter, as above described and shown with reference to FIGS. 2–5 of the accompanying drawings, has been given by mere way of not limiting example since, if desired, further practical approaches could be carried into effect other than those herein shown, but still within the general concept of the invention, according to which the cams are carried by a slider, it being possible to act on the latter through the operation of an adjusting device comprising att least two parts movable to each other, whereby the rotation of one part involves an axial displacement thereof and a simultaneous axial displacement of the other part made fast with said slider, thus providng a sum of the two movements.

From the foregoing, it will be appreciated that, according to the invention, the possibility is achieved to have all of the cams controlling the cylinder and plate needles correctly positioned at the same height or level and the possibilities of resetting the graduated indices correlated to the cam displacement to enable a successive adjustment, still as displacement magnitude equal for all of the cams. For example, upon total reset of the indices, by moving all of the adjustment indices through one notch, a same displacement would be provided for all of the cams.

What is claimed is:

1. In a circular knitting machine of the type having a needle cylinder rotatable relative to a fixed base and wherein each needle includes one or more heels supported for sliding movement between respective pairs of guide cams which define respective guide tracks, means for adjusting the positions of a pair of the guide cams to thereby control the length of the stroke of the needles comprising a support member fixedly supported with respect to the fixed base and having a portion thereof defining a guide, a manually adjustable element having a first threaded portion, said support member having a threaded portion engaging said first threaded portion of said manually adjustable element, a slider means supported for sliding movement within said guide, means for fixedly securing said pair of guide cams to said slider means, said manually adjustable element having a second threaded portion, the direction of the threads of said second portion being opposite to the direction of the threads of said first threaded portion, said slider means having a threaded portion engaging said second threaded portion of said manually adjustable element, whereby rotation of said manually adjustable element provides a displacement of the cam carrying slider means which is equal to the sum of the displacement of the manually adjustable elememt relative to the fixed support member and of the slider means relative to the manually adjustable element.

2. In a circular knitting machine as set forth by claim 1 wherein means are provided for limiting the range of sliding movement of said slider means within said guide, and wherein the sum of the pitch of the first threaded portion and the pitch of the second threaded portion of said manually adjustable element is equal to or greater than said range of motion.

3. In a circular knitting machine as set forth by claim 1 wherein the sum of the pitch of the first threaded portion and the pitch of the second threaded portion of said manually adjustable element is greater than said range of motion.

4. In a circular knitting machine as set forth by claim 1, wherein the pitch of said first threaded portion is equal to the pitch of the second threaded portion.

5. A circular knitting machine as set forth by claim 1 wherein the pitch of the first threaded portion is different from the pitch of the second threaded portion.

6. In a circular knitting machine as set forth by claim 1, and further including spring means for applying a spring force against said slider element for taking up play between the screw threads.

7. In a circular knitting machine as set forth by claim 1 wherein said slider means forms a first slider element and further including a second slider element mounted for sliding movement relative to said fixed support member, a second pair of cams fixedly connected to said second slider, a second manually adjustable element having a first threaded portion engaging a threaded portion on said fixed support and a second threaded portion engaging a threaded portion of said second slider element, and spring means comprising a first spring between said first slider element and said second slider element, and a second spring between said second slider element and said fixed support for taking up play in the various screw threads.

8. In a knitting machine as set forth by claim 1 including means for blocking movement of the adjustable element at a desired position relative to said first support member.

9. In a circular knitting machine as set forth by claim 1 wherein the threaded portion of the slider element comprises a threaded pin fixedly connected to the slider and threadedly engaging said second threaded portion of said adjustable element, said second screw portion being formed as an internal screw thread, said first threaded portion being formed as an external screw thread.

10. In a circular knitting machine as set forth by claim 9 wherein said threaded pin is connected to said slider element by means of a plurality of set screws, one of said set screws having a portion thereof projecting into an aperture formed in said fixed support element to limit the range of motion of said slider element.

* * * * *